US007178694B2

(12) United States Patent
Costa et al.

(10) Patent No.: US 7,178,694 B2
(45) Date of Patent: Feb. 20, 2007

(54) ANTI-CLOG DISCHARGE SPOUT

(75) Inventors: Lluis Costa, West Covina, CA (US); Daria Pietrowski, Huntington Beach, CA (US)

(73) Assignee: Saint-Gobain Calmar Inc., City of Industry, CA (US)

( * ) Notice: Subject to any disclaimer, the term of this patent is extended or adjusted under 35 U.S.C. 154(b) by 520 days.

(21) Appl. No.: 10/780,704

(22) Filed: Feb. 19, 2004

(65) Prior Publication Data

US 2005/0184094 A1 Aug. 25, 2005

(51) Int. Cl.
*B67B 5/00* (2006.01)

(52) U.S. Cl. ..... 222/153.13; 222/321.7

(58) Field of Classification Search ..... 222/153.13, 222/321.7, 321.6, 375, 182, 321.3, 402.1, 222/153.11, 1, 383.1
See application file for complete search history.

(56) References Cited

U.S. PATENT DOCUMENTS 3,089,624 A 5/1963 Micallef
3,474,939 A 10/1969 O'Connell et al.
3,949,906 A * 4/1976 Pettersen et al. ..... 222/153.13
4,494,680 A 1/1985 Corsette
5,027,982 A 7/1991 Demarest
5,085,347 A 2/1992 Hayes et al.
5,141,129 A * 8/1992 Jennings ..... 221/154
5,203,841 A 4/1993 Kitabayashi
5,379,924 A 1/1995 Taylor
5,649,645 A 7/1997 Demarest et al.
5,918,774 A 7/1999 Lund et al.
5,971,215 A * 10/1999 Bartsch ..... 222/153.13
5,975,370 A * 11/1999 Durliat ..... 222/153.06
6,257,451 B1 7/2001 Siegel et al.
6,405,904 B1 6/2002 De Laforcade
6,601,735 B2 * 8/2003 Milian et al. ..... 222/153.11

* cited by examiner

*Primary Examiner*—Lien M. Ngo
(74) *Attorney, Agent, or Firm*—Dykema Gossett PLLC

(57) ABSTRACT

A manually actuated pump sprayer adapted to be mounted on a container of liquid to be sprayed upon pump actuation is provided, and includes a plunger head having a side wall containing a discharge orifice. The plunger head may be reciprocable relative to the pump sprayer. An overcap may be independently rotatably disposed on the plunger head, and include a side wall overlying the discharge orifice in a condition of non-use. The side wall may include an opening disposable in alignment with the discharge orifice upon rotation of the overcap relative to the plunger head. A container closure may be provided for affixing the plunger head and the overcap relative to the container. The plunger head may be axially reciprocable relative to the container closure and may otherwise be locked relative to the container closure when in first and second orientations.

28 Claims, 2 Drawing Sheets

12
19
20
36
52
48
10
14
56
18
16
17
46
50
58
54
44
42
40

ANTI-CLOG DISCHARGE SPOUT

BACKGROUND OF INVENTION a. Field of Invention

The invention relates generally to manually actuated pump sprayers, and more particularly to such sprayers having means for preventing clogging of the discharge orifice due to product drying at the orifice and means for locking the plunger head for preventing plunger reciprocation.

b. Description of Related Art

Prior art pumps of the general type are known as having some type of anti-clog means such as the provision of a small projection extending into the orifice opening from outside the orifice cup. The projection is provided on a cover overlying the plunger head and shiftable relatively thereto for both sealing the orifice closed and for breaking away any accumulated dried product which may have accumulated on the outside surface of the orifice cup.

Alternatively, the discharge nozzle itself may be pivotable out of alignment from the discharge passage for protection against pollution, as well as for the prevention of dried product accumulation at the discharge orifice. In certain cases, a cover having a discharge opening may be provided for enabling discharge of product upon alignment of the opening with the discharge orifice. U.S. Pat. Nos. 5,203,841 and 5,027,982, the disclosures of which are incorporated herein by reference, are examples of such related art.

Other solutions for preventing clogging of the discharge orifice include the incorporation of an anti-clog element which confronts the discharge orifice upon rotation of the pump head to a predetermined orientation, as shown for example in U.S. Pat. No. 5,918,774, the disclosure of which is incorporated herein by reference. Yet further, as provided in U.S. Pat. No. 3,474,939, the disclosure of which is incorporated herein by reference, the plunger head may be rotated for locking in an up position whereby dispensing of product is prevented by the dual action of the plunger head being locked and the discharge orifice engaging a complementary cover.

These solutions to prevent orifice clogging are not, however, without their disadvantages. For example, extending a protrusion or the like into the orifice from the outer surface of the orifice cup for anti-clogging purposes, could over time distort the orifice and thereby adversely affect the quality of spray through the orifice. Also, the protrusion on the cover could after repeated use overshoot or undershoot the orifice in the non-use position such that the protrusion is out of axial alignment with the orifice in a non-use position thereby defeating the anti-clog feature.

The solutions which utilize a pivotable discharge nozzle have drawbacks in that the nozzle can become damaged after repeated pivoting thereof, and the presence of contaminants over time can further deteriorate the pivoting function. Lastly, the solutions which employ separate sealing elements or provide for locking of the plunger head have exemplary drawbacks in that existing designs are difficult to operate and fail to provide the requisite repeatability needed for adequate sealing of the discharge orifice for the life of the product.

It would therefore be of benefit to provide a manually actuated pump sprayer having in combination means for preventing clogging of the discharge orifice due to product drying at the orifice and means for locking the plunger head for preventing plunger reciprocation such that the anti-clogging feature functions in a repeatable and predictable manner over the life of the discharge assembly and the product being discharged. There also remains a need for a means for preventing clogging of the discharge orifice, which is robust in design, efficient to operate, simple to assemble and disassemble, and which is economically feasible to manufacture.

SUMMARY OF INVENTION

The invention solves the problems and overcomes the drawbacks and deficiencies of prior art anti-clog plunger head designs by providing in combination a manually actuated pump sprayer including means for preventing clogging of the discharge orifice due to product drying at the orifice and means for locking the plunger head for preventing plunger reciprocation.

The invention thus provides a manually actuated pump sprayer adapted to be mounted on a container of liquid to be sprayed upon pump actuation. The pump sprayer may include a plunger head having a side wall containing a discharge orifice. The plunger head may be reciprocable along a generally longitudinal axis of the pump sprayer against a predetermined biasing force provided by a spring. An overcap may be disposed on the plunger head and be independently rotatable relative to the plunger head. The overcap may include a side wall overlying the discharge orifice in a condition of non-use. The side wall may have an opening disposable in alignment with the discharge orifice upon rotation of the overcap relative to the plunger head. A container closure may be provided for affixing the plunger head and the overcap to the container, such that the plunger head may be axially reciprocable relative to the container closure when in a first orientation and axially restrained relative to the container closure when in a second orientation.

For the pump sprayer described above, the plunger head may include at least one ridge disposed on an inner surface of the side wall thereof, such that the ridge may be disposable in a complementary slot on the container closure when in the first orientation for permitting axial reciprocation of the plunger head relative to the container closure. The plunger head may further include at least one ridge disposed on an inner surface of the side wall thereof, such that the ridge may be contiguously disposable against a detent on the container closure when in the second orientation for preventing axial reciprocation of the plunger head relative to the container closure. The detent may include a sloped top surface such that as the plunger head is rotated from the first to the second orientation, the ridge slides against the top surface and axially shifts the plunger head away from the container closure to prevent axial reciprocation of the plunger head relative to the container closure. The container closure may include a concave catch member into which the ridge snap fits for locking the plunger head relative to the container closure.

For the pump sprayer described above, the plunger head may include at least one engagement means movable relative to the container closure when in the first orientation for permitting axial reciprocation of the plunger head relative to the container closure. The plunger head may further include at least one engagement means restrainable relative to the container closure when in the second orientation for preventing axial reciprocation of the plunger head relative to the container closure. Yet further, the plunger head may include at least one first means engageable with a complementary second means on the overcap for enabling attachment of the overcap onto the plunger head. The plunger head may also include at least one first means engageable with a complementary second means on the overcap for limiting rotation of the overcap relative to the plunger head.

For the pump sprayer described above, the plunger head may include at least one groove on an outer surface of the side wall thereof, such that the groove may be engageable with a complementary ridge on an inner surface of the side wall of the overcap for enabling attachment of the overcap onto the plunger head. The plunger head may further include at least one groove on an outer surface of the side wall thereof, such that the groove may have a predetermined length and be engageable with a complementary ridge on an inner surface of the side wall of the overcap for limiting rotation of the overcap relative to the plunger head.

In another embodiment of the pump sprayer described above, either the plunger head or the overcap may include at least one groove on the side wall thereof, the groove being engageable with a complementary ridge on the side wall of the other of the plunger head and the overcap for enabling attachment of the overcap onto the plunger head. Further, either the plunger head or the overcap may include at least one groove on the side wall thereof, the groove having a predetermined length and being engageable with a complementary ridge on the side wall of the other of the plunger head and the overcap for limiting rotation of the overcap relative to the plunger head. Yet further, the plunger head may include at least one groove on an outer surface of the side wall thereof, the groove having a predetermined length and being engageable with a complementary ridge on an inner surface of the side wall of the overcap for limiting rotation of the overcap relative to the plunger head, the groove further having first and second ends, such that when the ridge is disposed against the first end, the discharge orifice is disposed in the non-use condition, and when the ridge is disposed against the second end, the discharge orifice is aligned with the opening.

The invention yet further provides a manually actuated pump sprayer including a plunger head having a discharge orifice and being reciprocable relative to the pump sprayer. An overcap may be disposed on the plunger head and be rotatable relative to the plunger head, may overlie the discharge orifice in a condition of non-use, and may include an opening disposable in alignment with the discharge orifice in a condition of use. A container closure may be provided for affixing the plunger head and the overcap to the container. The plunger head may be axially reciprocable relative to the container closure when in a first orientation and axially restrained relative to the container closure when in a second orientation.

Additional features, advantages, and embodiments of the invention may be set forth or apparent from consideration of the following detailed description, drawings, and claims. Moreover, it is to be understood that both the foregoing summary of the invention and the following detailed description are exemplary and intended to provide further explanation without limiting the scope of the invention as claimed.

BRIEF DESCRIPTION OF THE DRAWINGS

The accompanying drawings, which are included to provide a further understanding of the invention and are incorporated in and constitute a part of this specification, illustrate preferred embodiments of the invention and together with the detail description serve to explain the principles of the invention. In the drawings.

DETAILED DESCRIPTION OF THE PREFERRED EMBODIMENTS

Figure 1:
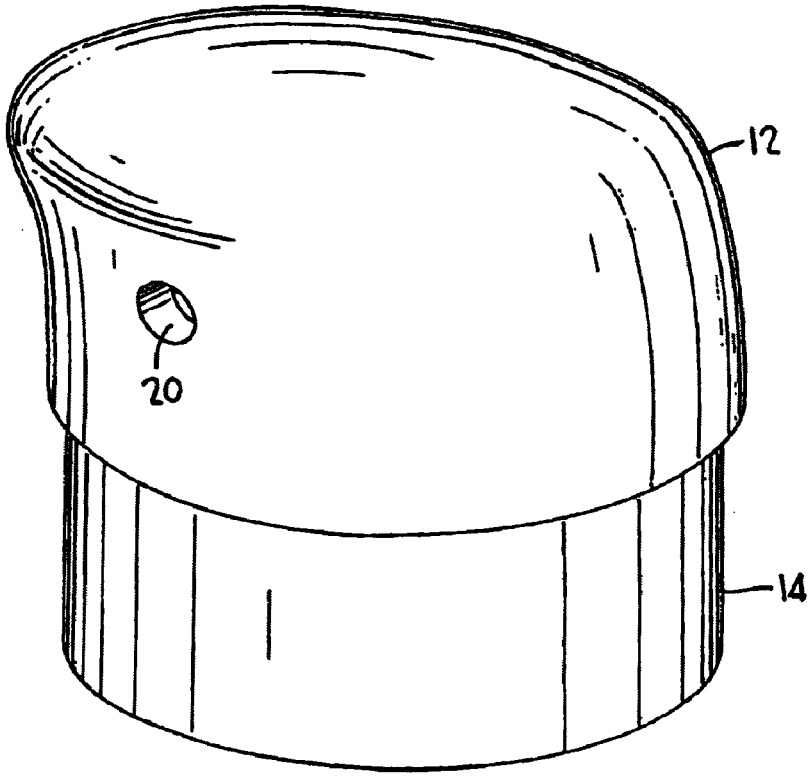
FIG. 1 is an isometric view of an overcap and a plunger head for a manually actuated pump sprayer according to the present invention.

Referring now to the drawings wherein like reference numerals designate corresponding parts throughout the several views, FIGS. 1–5 illustrate a manually actuated pump sprayer according to the present invention, generally designated 10.

As shown in FIGS. 1–5, pump sprayer 10 of the present invention is of the precompression variety and includes features and elements similar to the sprayers disclosed in U.S. Pat. Nos. 5,785,208, 6,158,625, 6,223,951, and 6,257,451, which are commonly owned herewith and the respective disclosures of which are incorporated in their entirety by reference. As illustrated, pump sprayer 10 may generally include an overcap 12 operatively connected to plunger head 14 which is spring biased and axially reciprocable relative to container closure 16 for discharging liquid product within a container (not shown). A dip tube (not shown) may be disposed within the container as is known in the art, and is operatively connected to an axially reciprocable plunger rod 17 having an enlarged tip 18 snap fitted into cavity 19 of plunger head 14. As described in detail in the aforementioned U.S. patents, generally, sprayer 10 may include a pump cylinder (not shown) receiving an axially reciprocable pump piston (not shown) mounted on the bottom of plunger rod 17 for discharging the contents of the container via the dip tube upon axial reciprocation of plunger head 14 and plunger rod 17 therewith. The pump cylinder may be snap-fitted or otherwise mounted within container closure 16, as also described in detail in the aforementioned U.S. patents.

Figure 2:
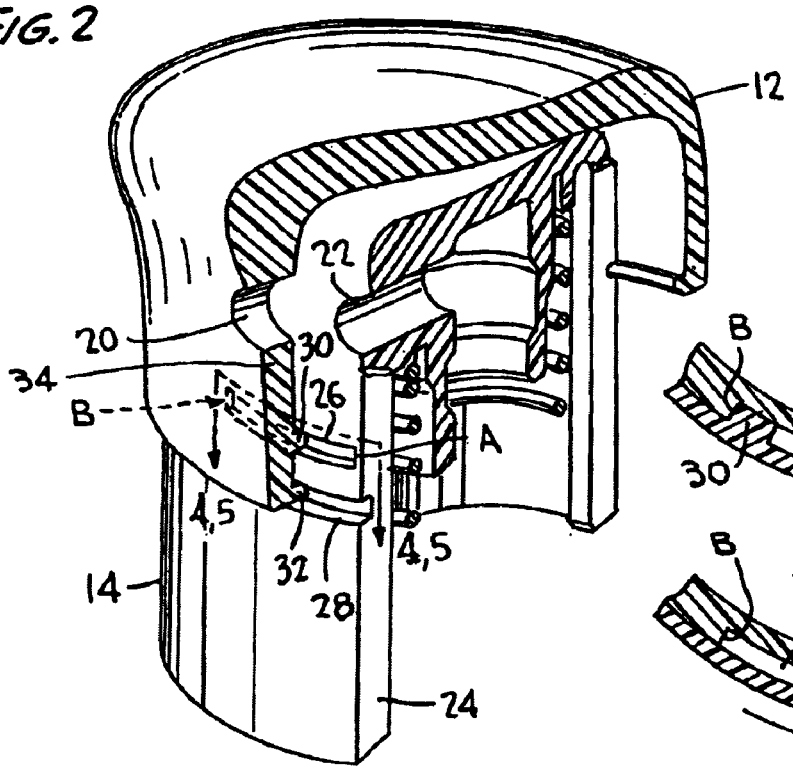
FIG. 2 is a cutout view of the overcap and the plunger head of FIG. 1, illustrating the internal features thereof for enabling limited rotation of the overcap relative to the plunger head.
Figure 4:
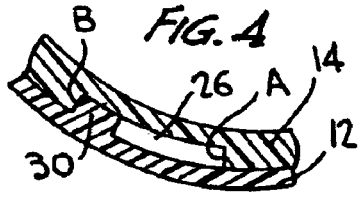
FIG. 4 is partial cross-sectional view of the overcap and the plunger head of FIG. 1 taken along line 4—4 in FIG. 2, illustrative of the overcap ridge for limiting rotational movement of the overcap in a first direction.
Figure 5:
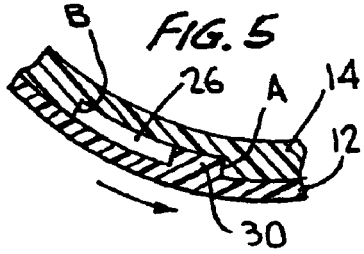
FIG. 5 is another partial cross-sectional view of the overcap and the plunger head of FIG. 1 taken along line 5–6 in FIG. 2, illustrative of the overcap ridge for limiting rotational movement of the overcap in a second opposite direction.
Figure 3:
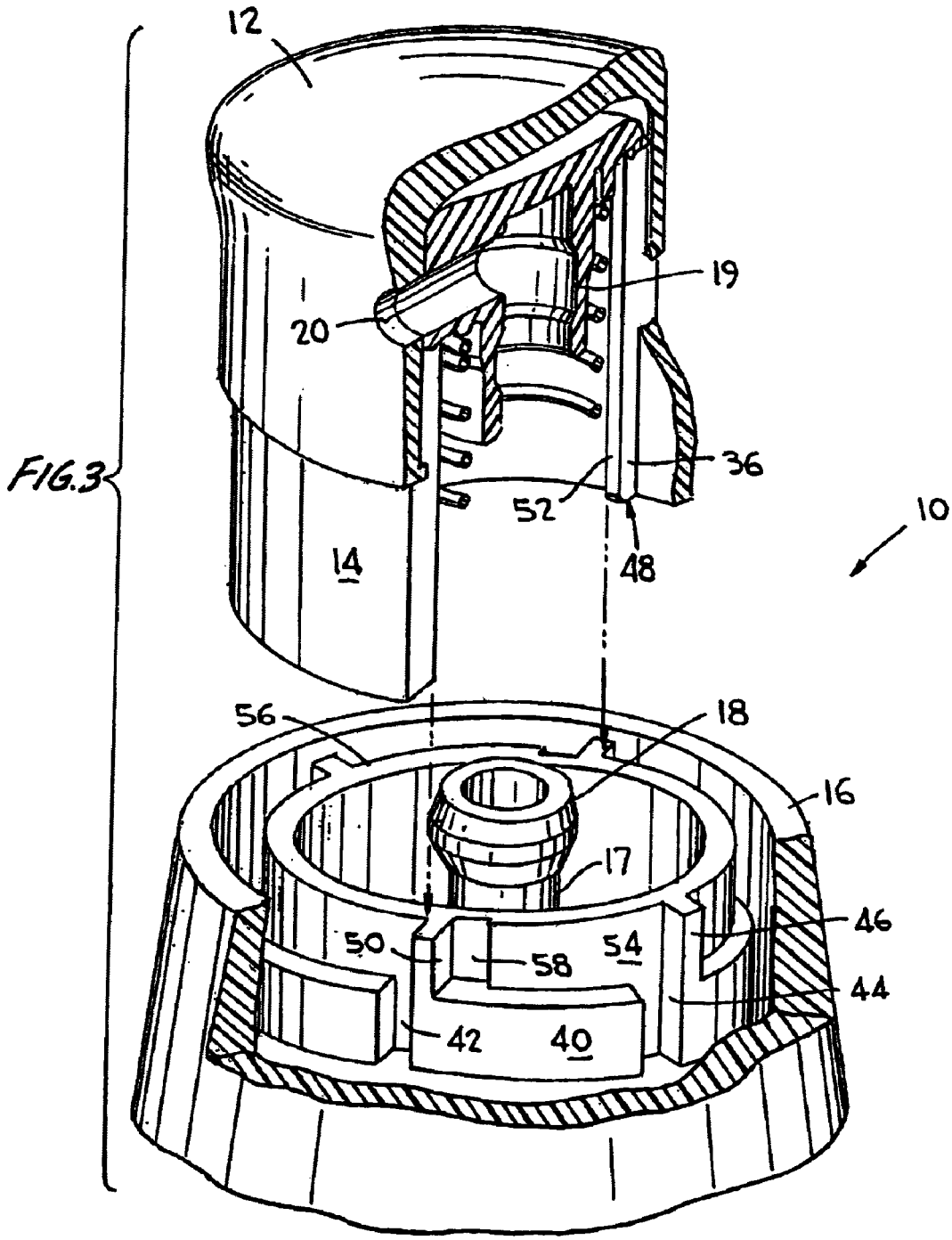
FIG. 3 is a cutout view of the pump sprayer of FIG. 1, illustrating the internal features thereof for enabling limited rotation of the overcap relative to the plunger head and locking of the overcap and plunger head assembly relative to a container closure.

Referring to FIGS. 2 and 3, overcap 12 may include orifice 20 rotatable into and out of alignment with discharge orifice 22 of plunger head 14. As shown in FIG. 2, the outer surface of wall 24 may include generally horizontal grooves 26, 28 disposed in respective engagement with ridges 30, 32 provided on the inner surface of wall 34. In the exemplary embodiment shown, bottom groove 28 may extend around the circumference of plunger head 14 for facilitating the snap fit of overcap 12 onto plunger head 14 by means of circumferentially extending ridge 32, and for further guiding the rotation of overcap 12 relative to plunger head 14. Top groove 26 may be formed of a predetermined arc-length for limiting the degree of rotation of overcap 12 relative to plunger head 14. As shown in FIGS. 2, 4 and 5, top groove 26 may generally extend from point A to point B and include ridge 30 also of a predetermined length disposed therein such that rotation of overcap 12 from point B to point A enables rotation of plunger head 14 in the counter-clockwise direction as shown and aligns orifices 20, 22, and rotation of overcap 12 from point A to point B misaligns orifices 20, 22 and enables further rotation of plunger head 14 in the clockwise direction as shown. Those skilled in the art would appreciate in view of this disclosure that the number, location and dimensions of grooves 26, 28 and ridges 30, 32 may be varied as needed around the respective perimeters of plunger head 14 and overcap 12, without departing from the scope of the present invention.

With orifices 20, 22 aligned as shown in FIG. 3, plunger head 14 may be axially reciprocated to discharge products in the container (not shown) through plunger rod 17, as discussed in detail in U.S. Pat. Nos. 5,785,208, 6,158,625, 6,223,951, and 6,257,451. In order to prevent axial reciprocation of plunger head 14, head 14 may include a plurality of ridges 36 engageable with top surface 38 of symmetrically disposed detents 40. Alternatively, upon counter-clockwise rotation of plunger head 14, ridges 36 may be disposed in axial alignment with complementary slots 42 for permitting axial reciprocation of plunger head 14.

Specifically, in the embodiment shown, counter-clockwise rotation of plunger head 14 via overcap 12 aligns ridges 36 with slots 42, whereby product in the container may be discharged through aligned orifices 20, 22 upon axial reciprocation of head 14. When disposed within slots 42, further counter-clockwise rotation of ridges 36 may be prevented by engagement of the side walls of each ridge 36 with walls 44 of catch 46. Thereafter, clockwise rotation of discharge overcap 12 may first rotate overcap 12 relative to plunger head 14 such that ridge 30 travels from point A to point B and orifices 20, 22 are disposed in the misaligned configuration shown in FIG. 2 so as to prevent further drying of product disposed at the inner and outer areas of orifices 20, 22. When ridge 30 is rotated such that it contacts side B of groove 26, further rotation of overcap 12 relative to plunger head 14 causes the bottom surface 48 of ridges 36 to slide on sloped top surface 38 of detent 40 until the opposite side wall of ridge 36 contacts wall 50 of catch 46. The top surface 38 may be sloped to eliminate any play in the axial movement of plunger head 14 such that head 14 is fixedly disposed relative to container closure 16 when rotated to its maximum clockwise locking position. At the locking position, at the same time as the side wall of ridge 36 contacts wall 50 of catch 46, with inner walls 52 of ridges 36 disposed in a resistance-fit engagement with outer annular wall 54 of ring 56, ridges 36 snap into engagement with catch members 58 which are radially disposed closer to the central axis of closure 16 as opposed to annular wall 54. In the embodiment shown, two opposing catch members 58 may be provided, although like catch members 58 may be symmetrically provided adjacent each catch 46.

The operation of pump sprayer 10 will now be described in detail.

In operation, with overcap 12 and plunger head 14 disposed in the configuration of FIG. 2, such that orifices 20, 22 are misaligned, sprayer 10 may be brought to its operational condition for dispensing product by rotating overcap 12 relative to plunger head 14 in a counter-clockwise direction in the embodiment of FIG. 2 until orifices 20, 22 are aligned as shown in FIG. 3 and ridges 36 are disposed in axial alignment with complementary slots 42 for permitting axial reciprocation of plunger head 14. In this configuration, sprayer 10 may be operated as needed for dispensing product through aligned orifices 20, 22.

In order to cover orifice 22 to prevent further drying of product disposed in the inner and outer areas thereof, overcap 12 may be rotated relative to plunger head 14 in a clockwise direction such that orifices 20, 22 are misaligned and, at the same time, ridge 30 travels from point A to point B in groove 26.

Lastly, in order to lock (i.e. prevent axial reciprocation of) plunger head 14 relative to closure 16, head 14 may be further rotated in the clockwise direction via overcap 12 such that ridges 36 snap-fit into catch members 58.

From the foregoing it can be seen that a simple and economical yet highly effective anti-clog device has been devised for a manually actuated pump sprayer in which an overcap may be rotated to tightly seal the discharge orifice closed in a non-use position. Yet further, the pump sprayer may be locked for shipping and during travel such that axial reciprocation of the plunger head relative to the container closure is prevented.

As discussed above, various modifications may be made to pump sprayer 10 without departing from the scope of the present invention. For example, detents 40 and their associated components may be disposed in a non-symmetrical or symmetrical (as shown) manner on closure 16. Alternatively, instead of being disposed on closure 16, detents 40 and their associated components may be disposed on the inner wall of plunger head 14, with ridges 36 being disposed in place of detents 40 on closure 16. Furthermore, grooves 26, 28 and ridges 30, 32 may be disposed in an oblique orientation, instead of the generally horizontal orientation illustrated in FIG. 2, in which case overcap 12 may shift upwards relative to plunger head 14 to align or misalign orifices 20, 22. Grooves 26, 28 and ridges 30, 32 may also be respectively disposed on overcap 12 and plunger head 14, instead of being respectively disposed on plunger head 14 and overcap 12, as illustrated in FIG. 2.

Although particular embodiments of the invention have been described in detail herein with reference to the accompanying drawings, it is to be understood that the invention is not limited to those particular embodiments, and that various changes and modifications may be effected therein by one skilled in the art without departing from the scope or spirit of the invention as defined in the appended claims.

What is claimed is:

1. A manually actuated pump sprayer adapted to be mounted on a container of liquid to be sprayed upon pump actuation, said pump sprayer comprising:

a plunger head having a side wall containing a discharge orifice, said plunger head being reciprocable along a generally longitudinal axis of said pump sprayer against a predetermined biasing force provided by a spring;

an overcap disposed on said plunger head and being independently rotatable relative to said plunger head, said overcap having a side wall overlying said discharge orifice in a condition of non-use, said side wall having an opening disposable in alignment with said discharge orifice upon rotation of said overcap relative to said plunger head; and a container closure for affixing said plunger head and said overcap to the container, said plunger head being axially reciprocable relative to said container closure when in a first orientation and being axially restrained relative to said container closure when in a second orientation.

2. The manually actuated pump sprayer according to claim 1, wherein said plunger head includes at least one engagement means movable relative to said container closure when in said first orientation for permitting axial reciprocation of said plunger head relative to said container closure.

3. The manually actuated pump sprayer according to claim 1, wherein said plunger head includes at least one ridge disposed on an inner surface of said side wall thereof, said ridge being disposable in a complementary slot on said container closure when in said first orientation for permitting axial reciprocation of said plunger head relative to said container closure.

4. The manually actuated pump sprayer according to claim 1, wherein said plunger head includes at least one engagement means restrainable relative to said container closure when in said second orientation for preventing axial reciprocation of said plunger head relative to said container closure.

5. The manually actuated pump sprayer according to claim 1, wherein said plunger head includes at least one ridge disposed on an inner surface of said side wall thereof, said ridge being contiguously disposable against a detent on said container closure when in said second orientation for preventing axial reciprocation of said plunger head relative to said container closure.

6. The manually actuated pump sprayer according to claim 5, wherein said detent includes a sloped top surface such that as said plunger head is rotated from said first to said second orientation, said ridge slides against said top surface and axially shifts said plunger head away from said container closure to prevent axial reciprocation of said plunger head relative to said container closure.

7. The manually actuated pump sprayer according to claim 6, wherein said container closure includes a concave catch member into which said ridge snap fits for locking said plunger head relative to said container closure.

8. The manually actuated pump sprayer according to claim 1, wherein said plunger head includes at least one first means engageable with a complementary second means on said overcap for enabling attachment of said overcap onto said plunger head.

9. The manually actuated pump sprayer according to claim 1, wherein said plunger head includes at least one groove on an outer surface of said side wall thereof, said groove being engageable with a complementary ridge on an inner surface of said side wall of said overcap for enabling attachment of said overcap onto said plunger head.

10. The manually actuated pump sprayer according to claim 1, wherein said plunger head includes at least one first means engageable with a complementary second means on said overcap for limiting rotation of said overcap relative to said plunger head.

11. The manually actuated pump sprayer according to claim 1, wherein said plunger head includes at least one groove on an outer surface of said side wall thereof, said groove having a predetermined length and being engageable with a complementary ridge on an inner surface of said side wall of said overcap for limiting rotation of said overcap relative to said plunger head.

12. The manually actuated pump sprayer according to claim 1, wherein one of said plunger head and said overcap includes at least one groove on said side wall thereof, said groove being engageable with a complementary ridge on said side wall of the other of said plunger head and said overcap for enabling attachment of said overcap onto said plunger head.

13. The manually actuated pump sprayer according to claim 1, wherein one of said plunger head and said overcap includes at least one groove on said side wall thereof, said groove having a predetermined length and being engageable with a complementary ridge on said side wall of the other of said plunger head and said overcap for limiting rotation of said overcap relative to said plunger head.

14. The manually actuated pump sprayer according to claim 1, wherein said plunger head includes at least one groove on an outer surface of said side wall thereof, said groove having a predetermined length and being engageable with a complementary ridge on an inner surface of said side wall of said overcap for limiting rotation of said overcap relative to said plunger head, said groove further having first and second ends, wherein when said ridge is disposed against said first end, said discharge orifice is disposed in said non-use condition, and when said ridge is disposed against said second end, said discharge orifice is aligned with said opening.

15. A manually actuated pump sprayer comprising:

a plunger head including a discharge orifice and being reciprocable relative to said pump sprayer;

an overcap disposed on said plunger head and being rotatable relative to said plunger head, said overcap overlying said discharge orifice in a condition of non-use and including an opening disposable in alignment with said discharge orifice in a condition of use; and a container closure for affixing said plunger head and said overcap to the container, said plunger head being axially reciprocable relative to said container closure when in a first orientation and being axially restrained relative to said container closure when in a second orientation.

16. The manually actuated pump sprayer according to claim 15, wherein said plunger head includes at least one engagement means movable relative to said container closure when in said first orientation for permitting axial reciprocation of said plunger head relative to said container closure.

17. The manually actuated pump sprayer according to claim 15, wherein said plunger head includes at least one ridge disposed on an inner surface of a side wall thereof, said ridge being disposable in a complementary slot on said container closure when in said first orientation for permitting axial reciprocation of said plunger head relative to said container closure.

18. The manually actuated pump sprayer according to claim 15, wherein said plunger head includes at least one engagement means restrainable relative to said container closure when in said second orientation for preventing axial reciprocation of said plunger head relative to said container closure.

19. The manually actuated pump sprayer according to claim 15, wherein said plunger head includes at least one ridge disposed on an inner surface of a side wall thereof, said ridge being contiguously disposable against a detent on said container closure when in said second orientation for preventing axial reciprocation of said plunger head relative to said container closure.

20. The manually actuated pump sprayer according to claim 19, wherein said detent includes a sloped top surface such that as said plunger head is rotated from said first to said second orientation, said ridge slides against said top surface and axially shifts said plunger head away from said container closure to prevent axial reciprocation of said plunger head relative to said container closure.

21. The manually actuated pump sprayer according to claim 20, wherein said container closure includes a concave catch member into which said ridge snap fits for locking said plunger head relative to said container closure.

22. The manually actuated pump sprayer according to claim 15, wherein said plunger head includes at least one first means engageable with a complementary second means on said overcap for enabling attachment of said overcap onto said plunger head.

23. The manually actuated pump sprayer according to claim 15, wherein said plunger head includes at least one groove on an outer surface of a side wall thereof, said groove being engageable with a complementary ridge on an inner surface of a side wall of said overcap for enabling attachment of said overcap onto said plunger head.

24. The manually actuated pump sprayer according to claim 15, wherein said plunger head includes at least one first means engageable with a complementary second means on said overcap for limiting rotation of said overcap relative to said plunger head.

25. The manually actuated pump sprayer according to claim 15, wherein said plunger head includes at least one groove on an outer surface of a side wall thereof, said groove having a predetermined length and being engageable with a complementary ridge on an inner surface of a side wall of said overcap for limiting rotation of said overcap relative to said plunger head.

26. The manually actuated pump sprayer according to claim 15, wherein one of said plunger head and said overcap includes at least one groove on a side wall thereof, said groove being engageable with a complementary ridge on a side wall of the other of said plunger head and said overcap for enabling attachment of said overcap onto said plunger head.

27. The manually actuated pump sprayer according to claim 15, wherein one of said plunger head and said overcap includes at least one groove on a side wall thereof, said groove having a predetermined length and being engageable with a complementary ridge on a side wall of the other of said plunger head and said overcap for limiting rotation of said overcap relative to said plunger head.

28. The manually actuated pump sprayer according to claim 15, wherein said plunger head includes at least one groove on an outer surface of a side wall thereof, said groove having a predetermined length and being engageable with a complementary ridge on an inner surface of a side wall of said overcap for limiting rotation of said overcap relative to said plunger head, said groove further having first and second ends, wherein when said ridge is disposed against said first end, said discharge orifice is disposed in said non-use condition, and when said ridge is disposed against said second end, said discharge orifice is disposed in said use condition.

* * * * *